United States Patent [19]

Mande et al.

[11] Patent Number: 4,506,253

[45] Date of Patent: Mar. 19, 1985

[54] SUPERVISORY AND CONTROL CIRCUIT FOR ALARM SYSTEM

[75] Inventors: Irving Mande, Westport; Robert W. Right, Huntington; George W. Killian, Stamford, all of Conn.

[73] Assignee: General Signal Corporation, Stamford, Conn.

[21] Appl. No.: 455,075

[22] Filed: Jan. 3, 1983

[51] Int. Cl.[3] ..... G08B 29/00

[52] U.S. Cl. ..... 340/506; 340/510; 340/511; 340/513

[58] Field of Search ..... 340/506, 508, 507, 509, 340/510–514, 521, 531, 537, 693

[56] References Cited

U.S. PATENT DOCUMENTS

| | | | |
|---|---|---|---|
| 3,521,276 | 7/1970 | Raber | 340/513 |
| 3,569,964 | 3/1971 | Mande | 340/513 |
| 3,611,362 | 10/1971 | Scott | 340/513 |
| 3,618,081 | 11/1971 | Morrow | 340/513 |
| 3,936,821 | 2/1976 | Cooper et al. | 340/513 |

*Primary Examiner*—Donnie L. Crosland

*Attorney, Agent, or Firm*—Ronald Reichman; Milton E. Kleinman; George W. Killian

[57] ABSTRACT

An alarm detection, indication and supervision circuit with reduced power drain during failure of commerical power supply whereby standby batteries may maintain detection capability for an extended period. Separate detection and alarm indication loops are provided each with an end-of-line resistor which is removed from the circuit in response to a commercial power failure. A nearly unlimited number of detectors may be used on the detection circuit and each may have an auxiliary relay for control of local apparatus to permit local control, under changing ambient conditions. In response to an alarm signal, the potential on both loops is switched from a limited current supply to a hard supply and the polarity is reversed.

16 Claims, 2 Drawing Figures

SUPERVISORY AND CONTROL CIRCUIT FOR ALARM SYSTEM

FIELD OF THE INVENTION

Alarm systems for indicating and responding to any of a wide variety of nonstandard conditions are widely and extensively used in a variety of locations and to indicate a variety of nonstandard conditions. In response to the detection of the nonstandard condition, various responses may be desirable. These may include: sounding an alarm, turning off or on an associated device, signaling a remote site, closing doors, shutting down heating and ventilating systems, and any of a wide variety of other actions which may promote the general safety and welfare of life and property. The invention to be described herein may be used in a wide variety of circumstances, conditions and locations. The system will be found to be applicable to installations requiring one or more devices for detecting a nonstandard condition and wherein, in response to such detection, audible and/or visual alarms and/or the control of auxiliary equipment may be desirable.

Systems of the general type described might find utility, for example, in a household, apartment, small business, or other location where it is desirable to have detectors which respond to abnormal conditions including fire or smoke detection, temperature or moisture conditions outside desired limits and/or any of a wide variety of other conditions requiring attention. The system may also be incorporated into a multi-zone system.

DESCRIPTION OF THE PRIOR ART

Systems providing some of general features set forth hereinabove are well known and widely used as exemplified by the wide variety of fire, smoke and/or burglar alarm systems frequently provided in the types of locations mentioned. The detector devices, in one type of prior art system, may be connected in a closed loop which is opened in response to any of the abnormal conditions. In response to the detection of the open loop, various alarm signals which may comprise audible/visual signals may be actuated. In other types of systems, the detecting devices are normally open, or high impedance devices bridged across a cable pair. In response to the detection of an abnormal condition, the detectors close, or switch to a lower impedance condition, which is detected by a supervisory circuit at a control center and in response to such detection appropriate visual/audible signals may be activated and/or other action may take place either automatically or under the control of an attendant.

In both of these systems, it will be seen that one loop, or a cable pair, is used for the detectors and that separate wiring is required for the audible/visual signals and/or other controls.

U.S. Pat. No. 3,611,362 issued to Robert D. Scott on Oct. 5, 1971 describes an alarm sensing and indicating system wherein both the detectors and the alarm devices may be bridged across a single cable pair. The system uses low energy of one polarity for supervision and is energized at a higher level with a reverse polarity in response to the sensing of an alarm condition. The Scott circuit functions admirably but has a shortcoming if used in installations wherein it is expedient to use detectors which include auxiliary relays which may be used to control other devices to enhance the protection of life and property. That is, in the Scott system, the first detector to sense a nonstandard condition will cause a line polarity reversal and thereby disconnect, or render insensitive, all remaining detector units. It will be apparent that in some types of installations and circumstances, it would be desirable to have at least some of the plurality of detectors be able to respond to the changing conditions of the situation and, when and if appropriate, close passageways, ventilating systems, shut down heating plants and/or initiate any other action which may promote the welfare and safety of personnel and property. The Scott system is also limited to systems wherein the only line current prior to activation of a detector is the current which results from the end-of-line resistor.

U.S. Pat. No. 3,569,964 issued Mar. 9, 1971 to Irving Mande describes a supervisory alarm system which provides a reverse polarity on the supervised cable pairs under selected conditions. More specifically, the Mande patent teaches a supervision circuit using a typical end-of-line resistor and which provides for extended stand-by service in the event of a commercial power failure by reversing the line polarity to electrically disconnect the end of line resistor, which is in series with a diode. This reduces the power drain from the stand-by batteries.

While the Scott and Mande patents both teach line polarity reversal, their function and inventive features have little in common.

A patent application entitled "Alarm System with Detectors and Signaling Devices on the Same Cable Pair" was filed on Nov. 10, 1982 and assigned Ser. No. 440,643 by inventors Right and Mande who assigned the application to the same assignee as the present application. That application had some features in common with the Scott patent 3,611,362 but provided a system wherein detectors could continue to respond to changing ambient conditions even after the first nonstandard condition had been detected and audio/visual alarms initiated. That is, the local detectors could continue to respond to abnormal conditions and exercise control over local equipment in a manner to promote the safety of personnel and equipment.

SUMMARY OF THE INVENTION

The present invention provides an economical, efficient and convenient system which may detect and respond to any of a wide variety of nonstandard conditions and in response to sensing the first detected nonstandard condition one or more audio and/or visual alarms may be activated. The system provides for an almost unlimited number of nonpolarized, detecting devices, each of which may include means for controlling other apparatus which it may be expedient to control in order to minimize the potential damage which might take place as a result of the detected nonstandard condition. The detection. devices and the alarm devices are bridged across separate cable pairs so that the cable pair having the bridged detection devices may be expeditiously designated the detection line while the other cable pair having the bridged alarm device may be conveniently and expeditiously designated the alarm line. Central station equipment which may expeditiously comprise both relays and solid state circuitry can supervise the integrity, by which is meant the continuity, of both the detection and alarm lines. A conventional end-of-line resistor provides a normal line current and such a normal line current is sensed to assure line integrity. In addition, the alarm line may be supervised to assure that it does not have an inadvertent short or shunt.

In order to assure some continuity of the protection in the event of the failure of the commercial power supply, standby batteries are provided. However, in order to extend the time duration that the system can detect and respond to nonstandard conditions during the time of a commercial AC power failure, the end-of-line resistors are, in effect, removed from the circuit during the time of the commercial power failure. Accordingly, during such time, the system does not supervise line integrity. However, giving up this features reduces the power drain on the standby batteries and noticeably extends the period during which the system may detect and respond to nonstandard conditions.

The end-of-line resistor on the detector line is, in effect, removed from the circuit by having a series diode in circuit therewith and causing a polarity reversal to be applied to the detector line in response to failure of commercial power. The end-of-line resistor associated with the alarm line is disconnected by the simple expedient of removing potential from the alarm line in response to a commercial power failure.

With or without a power failure and in the event of the detection of a nonstandard condition, the current limiting line integrity detection circuit is removed and a hard DC potential of reverse polarity is applied to both lines. The alarm devices, which have a series connected diode, are activated in response to the polarity reversal. The polarity reversal on the detection circuit will, in effect, disconnect the end-of-line resistor. However, since the detectors include a diode bridge, they can continue to detect ambient nonstandard conditions and respond thereto and as a result of such response, an associated relay may be operated and its contact used to control local apparatus as may be expedient to promote the safety of equipment and personnel.

The central station equipment includes a pair of voltage comparators for each of the lines with one comparator designed to respond to an open line condition while the other comparator will respond to a current exceeding a normal standby value. In response to any one of these conditions, other than the over current in the detector line, a trouble signal will be provided to indicate that some trouble exists within the system. A trouble signal comprises a system problem as opposed to an alarm which indicates the presence of a nonstandard condition within the area being protected. Three relays are provided and under selected conditions it may be necessary to provide a slave relay for one or more of the three relays. One relay is normally operated as long as the commercial power supply is operative and there is no alarm condition. In response to a trouble condition, a trouble relay is activated. In response to an alarm condition, an alarm relay is locked into an actuated position and it releases the power failure relay which, in turn, inhibits or releases the trouble relay.

From the foregoing, it will be seen that a principle object of the invention is to provide a new and improved detection and alarm system which may incorporate detectors, signaling devices and alarms into a comprehensive, convenient and economical system.

It is another object of the invention to provide a system incorporating separate detection and alarm lines wherein an almost unlimited number of detection devices may be included on the detection line.

It is another object of the invention to provide a system wherein the detection line may incorporate a plurality of detection devices which may respond to nonstandard ambient conditions and control local apparatus subsequent to the activation of the first detection device followed by the resultant audio/visual alarm signals.

It is another object of the invention to provide a system which provides for extended standby operation in the event of a commercial power failure by disconnecting the end-of-line resistors to reduce battery drain.

It is another object of the invention to provide a system which applies a hard DC potential to the detection line subsequent to the detection of, and response to, the first activated detection device.

Other and more detailed advantages and objectives of the invention will become more apparent as the following description is considered together with the drawing.

BRIEF DESCRIPTION OF THE DRAWING

The drawing comprises two figures which, when arranged side by side and in numeric order, comprises a circuit diagram of typical components which may be employed in the system. The circuit diagram employs conventional symbols for the various components. In order to further facilitate purusal and understanding of the circuit of the invention, a system of designation has been employed which will aid in identifying the character, purpose and location of the element. More specifically, when the element constitutes an electrical device, the first character of the designation will comprise a letter indicative of the nature of the device. For example, when the first letter of the designation is D, R or T, the designated element is a diode, resistor or transistor, respectively. The relays are given mnemonic designators to facilitate correlation between function and designation. Identifiers without an initial alpha character, indicate other elements such as terminals, junctions, individual wires and/or other elements and devices.

The interconnections between the figures are evident when the figures are positioned in numeric order from left to right.

DESCRIPTION OF THE PREFERRED EMBODIMENT

Depending upon a variety of conditions including the area and/or number of rooms and/or floors within an area to be protected, the system may comprise one or more zones of protection. The description to follow will deal with a single zone only, but it should be understood that the principle and concepts may be employed in a multi-zone system. The system is described primarily in terms of fire and smoke detection and appropriate alarming in response to detection thereof. However, it should be understood that the system is equally applicable to systems required to detect and respond to a wide variety of other types of nonstandard conditions. These conditions may include: nonstandard temperatures, power failures, device failures, presence of personnel in unauthorized area, open passageways, and/or any of a wide variety of other conditions or circumstances which may be detected and cause the opening or closing of an electric circuit.

In typical alarm systems, there is a central station or central control point from which wires to each of the protected zones is extended. In some situations, the central control station may be at a remote site and may be attended. The systems are generally designed to provide alarm and/or signals at both the central station and within the zone of protection.

Figure 1:
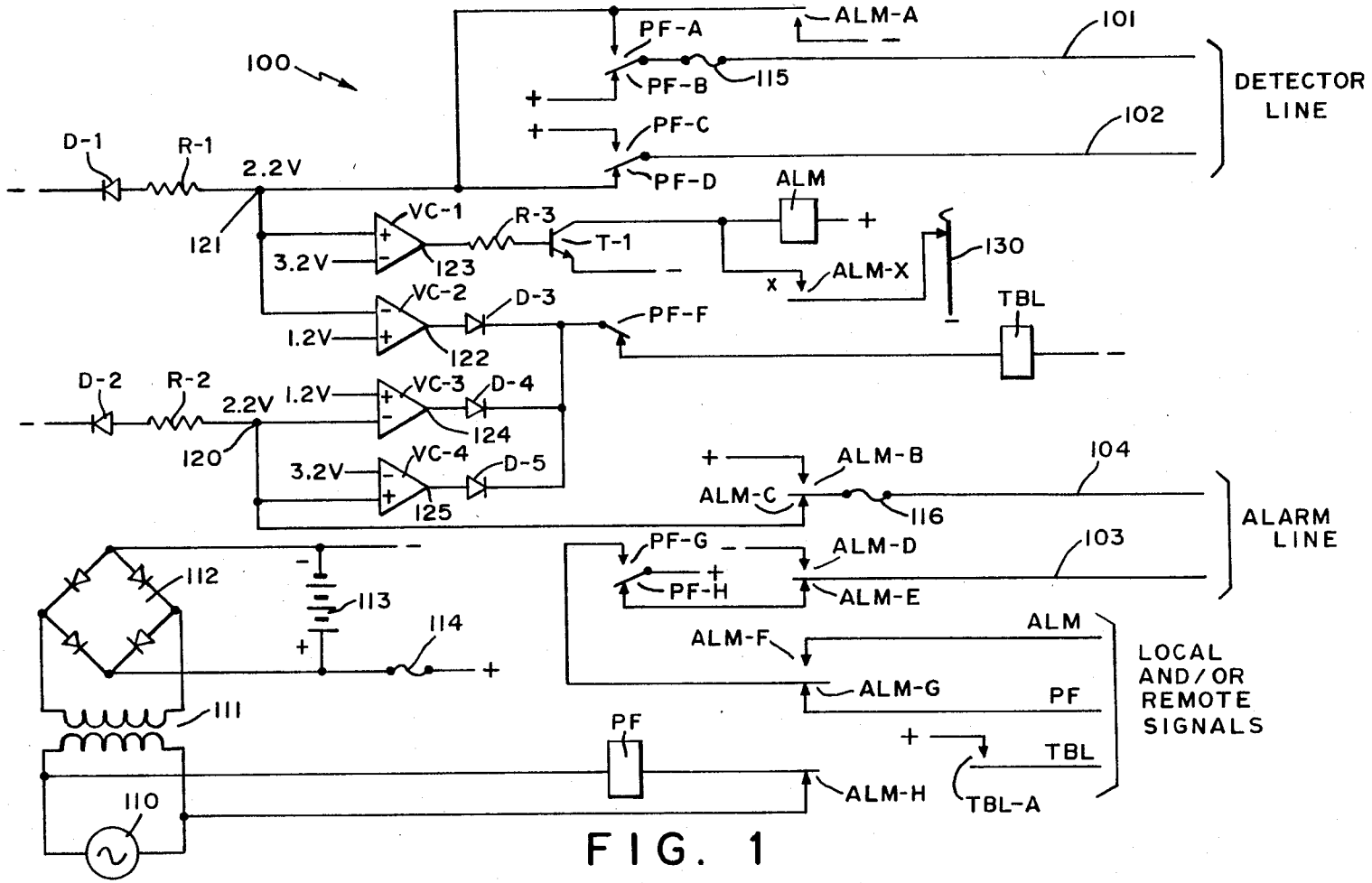
FIG. 1 comprises typical apparatus used at the control center.
Figure 2:
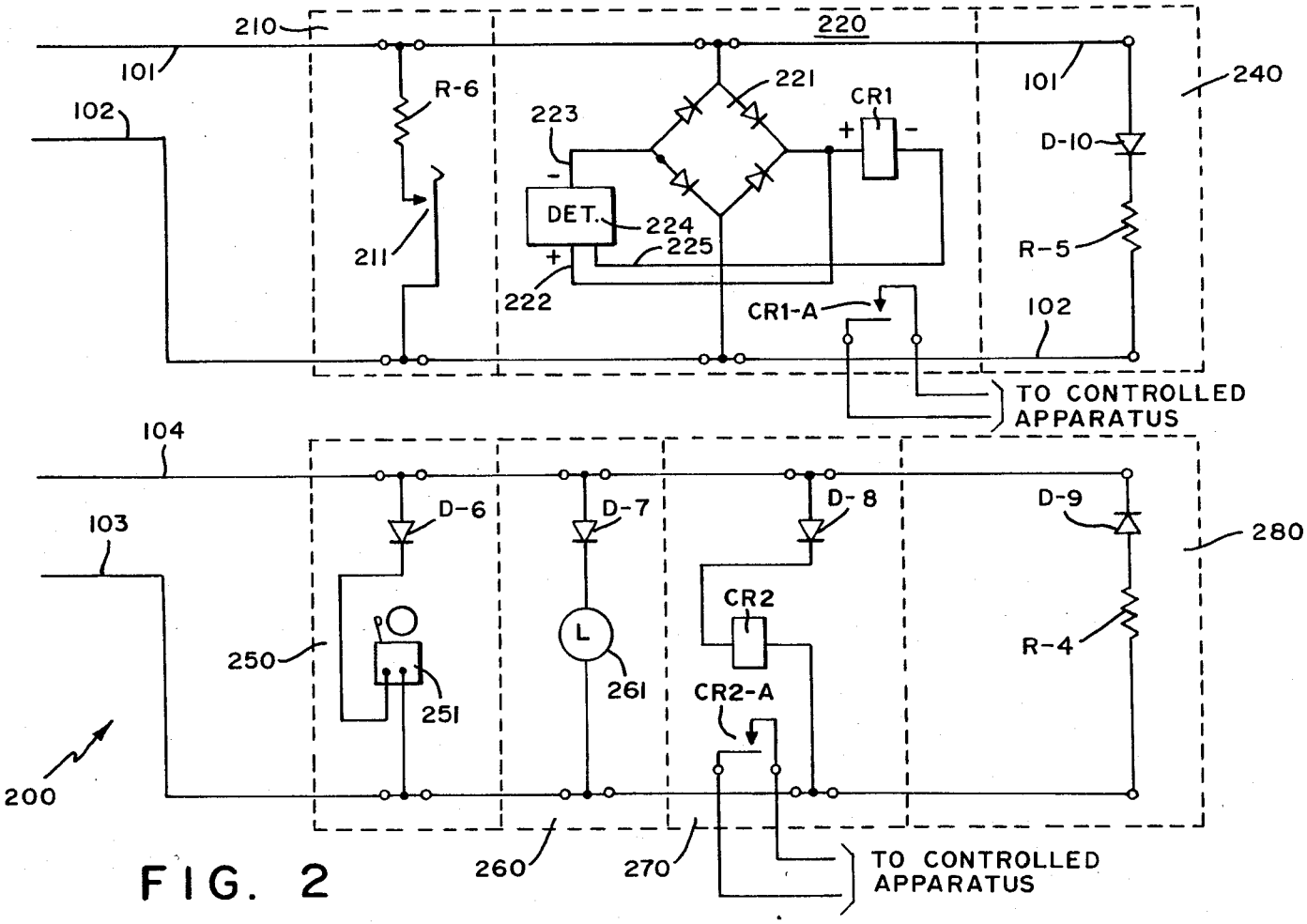
FIG. 2 illustrate typical components which may be bridged across the detector and alarm lines.

In the drawing, FIG. 1 comprises the basic and essential equipment provided at a control station and FIG. 2 indicates typical equipment which might be used in the protected zone. Conventional symbols have been used and will be more fully explained in the description presented hereinbelow.

The circuit of the system may be most conveniently and expeditiously reviewed and analyzed by arranging FIGS. 1 and 2 in numeric order from left to right. FIG. 1 comprises a central station indicated generally as 100. Extending from the central station 100 is a detector line comprising individual wires 101 and 102. In addition, an alarm line extends from the central station 100 with individual wires 103 and 104. As may be seen, the wires 101 through 104 extend from FIG. 1 to FIG. 2. FIG. 2 represent the supervised zone designated generally as 200.

At the central station 100, there is a source of alternating current potential which is indicated as 110 and which, through a transformer 111, energizes a diode bridge 112 which, in turn, maintains a charge on batteries 113. It should be understood that this power supply circuit does not comprise an integral portion of the inventive concept and that the power supply portion is shown only in a general manner. That is, in an actual installation, various fuses, alarms, safety check circuits and protection techniques would normally be provided in order to assure maintaining a proper charge on the batteries 113 without creating an overcharged condition and/or other difficulties arising from nonstandard potentials at AC source 110.

At the central station 100, there will be seen a plurality of + (plus) symbols which indicate a connection to the positive terminal of battery 113 through fuse 114. It should be understood that all connections terminating with a + symbol are connected together and connected to the positive terminal of the DC power supply 113 through the fuse 114. In like manner, the points designated with a − (minus) symbol constitute a connection to the negative terminal of the DC power supply 114. Depending upon local codes and/or other considerations, one or the other, or neither, of the positive or negative terminals of the DC power supply may be connected to an earth ground and/or chassis ground. For equipment of this type, the negative is usually the one which is grounded.

The central station 100 will be seen to include three relays, PF, ALM and TBL. The operating coil of the relays is indicated as a rectangle and all contacts associated with the respective relays are located in vertical alignment with the associated coil. In accordance with one convention for illustrating relay contacts, they are drawn in their normal condition which they assume when the circuit is energized and not indicating any trouble, abnormal or alarm condition. The convention followed is that the straight line portion of the contact is considered as the moving swinger, or armature, and that it moves towards the rectangle representing the relay coil in response to energizing of the relay. In this particular instance, the PF relay is normally operated under the described conditions, and therefore, all of its swingers are drawn as moved towards the PF relay coil area. The contact pairs of each relay are designated to match the associated relay and an alphabetic suffix is added to distinguish one contact from another.

The central station 100 also includes four voltage comparators which respond to changes in line current above or below a normal value and which are designated VC-1 through VC-4, a transistor T-1, a variety of diodes D-1 through D-5, and resistors R-1 and R-2. These together with other elements and components will be described more fully in the specification to follow.

FIG. 2 illustrates some of the typical components which may be bridged across the detection pair comprising wires 101 and 102 within the supervised zone 200. This equipment may include alarm sensing or manual singaling devices as illustrated generally at 220 and 210, respectively. In addition, the system will generally include an end-of-line resistor network indicated generally as 240 and which is bridged across the remote end of the cable pair 101 and 102.

FIG. 2 also illustrates some of the typical components which may be bridged across the alarm line comprising leads 103 and 104 within the supervised zone 200. This equipment may include an audible alarm 250, a visual alarm 260 and a control device 270. In addition, the alarm pair 103 and 104 will normally include and end-of-line network 280 which is bridged across the remote end of the alarm pair.

Returning now to FIG. 1, it should be understood that the PF relay is a power fail relay because it responds to a power failure of the commercial power supply 110 by releasing. The ALM relay is an alarm relay because it will respond to alarm conditions as detected by apparatus connected to the detector line 101 and 102. The TBL is a trouble relay because it will respond to various conditions within the system which indicate a malfunction. The PF relay is actuated from the AC power supply 110 and will remain activated so long as the commercial AC power supply 110 is available and the ALM-H contacts of the alarm relay remain closed. With the PF relay normally operated, it will be seen that contacts PF-B apply a + potential throught fuse 115 to the detector line 101. A-potential at diode D-1 is applied through resistor R-1 and through contacts PF-D to the detector line 102. In a generally analagous manner, a positive potential is applied through contacts PF-H and released contacts ALM-E to the alarm line 103. A negative potential is applied through diode D-2, resistor R-2 and relay contacts ALM-C and fuse 116 to the alarm line 104. It will be seen that any current drawn by devices bridged across the wires 101 and 102 of the detector line, will be limited by the resistor R-1. In like manner, the current drawn by any device bridged across the wire 103 and 104 of the alarm line will be limited by the resistor R-2. As a memory aid, the wires 101 and 103 which normally have a positive potential are odd numbers while the lines 102 and 104 which normally have a negative potential are even numbers.

The diodes D-1 and D-2 enhance sensitivity and could be omitted if reduced sensitivity is acceptable.

With the positive potential applied to line 103 of the alarm line and a negative applied to lead 104, it will be evident that no current will pass through the audible alarm 250 because of the blocking diode D-6. In like manner, the visual alarm 260 will not be illuminated because of the blocking diode D-7. And, in like manner, the control device 270 will not draw any current due to the blocking diode D-8. However, the diode D-9 associated with the end-of-line resistor R-4 is poled in an opposite direction and therefore, current will pass through resistor R-4 and diode D-9. The exact current that flows will, of course, be a function of the value of the resistors R-4 and R-2 together with the distributed resistance of the line wires 103 and 104, any leakage resistance and the potential of the DC supply 113. Although other potentials and resistors may be used, typically the DC supply 113 will be a 24 volt supply and the end-of-line resistor will be of the order of 1,800 ohms and the loop resistance of the alarm line 103 and 104 will have a value ranging up to approximately 180 ohlms. The resistor R-2 will normally have a value of the order of 200 ohms so that the potential at the point 120 will have a potential of the order of 2.2 volts.

Under normal condition with a positive potential applied to lead 101 of the detector line and a negative potential applied to lead 102, it will be seen that no current will pass through the manual signaling station 210 because the contacts of the switch 211 are open.

The detector 220 includes a diode bridge 221 and therefore, irrespective of the polarity of the potential on the detector pair 101 and 102, a positive potential may be applied to the lower terminal 222 and a negative potential applied to the upper terminal 223 of the detector 224. As suggested, the detector 264 may comprise a smoke detector. However, it should be understood that it may comprise any other type of detector or device that is suitable for detecting the desired nonstandard condition and which will close a pair of contacts to connect terminal 223 to lead 225. It will be seen that the detector 220, because of the diode bridge 221 will be operative irrespective of the polarity applied to the cable pair 101 and 102. Typical smoke detectors 220 draw a standby current of the order of 50 microamperes.

Considering now the end-of-line resistor 240, it will be seen that it comprises a resistor R-5 and a diode D-10 coupled across the remote end of cable pair 101 and 102. The arrangement of the installation is such that the end-of-line resistor 240 is at the end of the cable pair 101 and 102 which is most remote from the control station 100. With the polarity indicated, a current will flow through the diode D-10 and resistor R-5. The result will be that the potential at point 121 will be at approximately 2.2 volts when the resistor R-5 has a value of the order of 1,800 ohms and the detector line loop resistance approximates that of the alarm line loop resistance. Since each of the detectors 220 may draw a standby current of the order of 50 microamperes, it will be obvious that if a substantial numbers of detectors 220 is used, the line current will be increased and the potential at point 121 may be altered. This may limit the number of detectors 220 which can be used and/or require modification or adjustment of the resistor R-1 and/or R-5. However, even with these adjustments, it will be seen that the number of detectors 220 cannot be unlimited although the desired number will rarely exceed the allowable limit.

Systems of the type being described may be of critical importance in protecting life and property in the event of the occurrence of any of the nonstandard conditions which are monitored by the various devices bridged across the detector line comprising leads 101 and 102. The audio/visual alarms are coupled to the alarm pair comprising wires 103 and 104. In order to maintain the reliability and integrity of the system, it is necessary to supervise or monitor the integrity, by which is meant the continuity, of the detector line and the alarm line. The end-of-line resistors 240 and 280 provide this capability. So long as the supervised cable pairs have continuity or integrity, a current having a generally predetermined value will flow. The magnitude of the current in the detector line will depend, to a limited extent, on the number of detectors 220 which are bridged across the line. Subsequently, it will be shown that the interruption of the normal current in either the detector line or the alarm line will initiate a trouble signal. In like manner, a short across the alarm line and/or a shunt of sufficiently low resistance to cause a malfunction, will also initiate a trouble signal.

The capability of the system to respond to and report abnormal conditions will depend upon the physical presence of the various devices 210, 220, 250, 260 and 270. Accordingly, and in accordance with a standard wiring technique, each of these devices has an "in" and "out" terminal. These are provided and illustrated in accordance with standard practice in the art. Any who desire additional information concerning these terminals will find it in the aforementioned application of Right et al.

As previously explained under normal conditions, there is a normal flow of current from the positive side of line 101 through the end-of-line resistor R-5 and the parallel combination of all the smoke detectors 220 to the negative side of the line 102 and eventually through current limiting resistor R-1 and diode D-1 to the negative potential. The values of the resistors R-1 and R-5 together with the loop resistance of the wires 101 and 102 is selected so that the voltage at terminal 121, which couples to the negative input terminal of the voltage comparator VC-2, is such that as long as the cable pair 101 and 102 has continuity, the voltage comparator VC-2 will maintain a negative output at terminal 122. It should also be understood that each of the devices 220 may introduce a very small standby line current and that the maximum value of this accumulated current must be considered together with the factors already mentioned. The maximum number of smoke detectors 220 which may be used is controlled by the various factors cited and specifically by the ability of the voltage comparator VC-1 to distinguish between the various potentials at points 121 caused by the system under all possible conditions of temperature, voltage range, connected devices 220, and/or other factors known to those skilled in the art. With the negative output at terminal 122, a negative potential is held at the left-hand terminal of the TBL relay and it will not operate. However, if anything should happen to the continuity of the cable pair 101 and 102, the current described will be interrupted or reduced and the terminal 121 will assume nearly full negative potential and the voltage comparator VC-2 will place a positive potential at terminal 122 and thereby actuate the TBL relay. As soon as relay TBL is actuated, it will close contacts TBL-A which may be used to operate any type of local trouble signal and/or to transmit a trouble signal to a remote site. The loss of integrity on the cable pair 101 and 102 does not necessarily constitute a hazzard to personnel and property within the protected zone. However, it does indicate that the capability for detecting nonstandard conditions in the protected zone may be impaired. It should be noted that it is stated that the capability of the system may be impaired and not that the system is inoperative.

For example, if the integrity of the line was lost because the end-of-line resistor 240 had become disconnected, it would still be possible for the central station 100 to respond to any of the detectors or signaling device and for the central station to actuate the various alarms and/or control devices.

The integrity of the alarm line comprising lines 103 and 104 is supervised in substantially the same manner with current flowing through resistor R-4 and R-2 to cause a potential of the order of 2.2 volts to be placed at point 120 and applied to the negative input of voltage comparator VC-3 which, as long as things are normal, will have a negative output at point 124. However, if the alarm line should go open, the line current will be reduced to substantially zero and the terminal 120 will fall to the negative potential thereby providing a positive output at terminal 124 and operating the trouble relay TBL with the same results as aforedescribed. Accordingly, it has been shown that if either the detector line or the alarm line should be open circuited, a trouble signal will be produced.

If some malfunction should cause a short, or a sufficiently low resistance shunt across the lines 103 and 104 of the alarm line, the current from the positive terminal at relay contact PF-H through contacts ALM-E to the line 103 and through the shunt, or short, to line 104 and ultimately through resistor R-2 to the negative potential will increase. This will raise the potential at terminal 120 and when this increased potential is applied as an input to voltage comparator VC-4, a positive output will be placed on terminal 125 thereby operating the trouble relay TBL in the manner aforedescribed to provide a trouble signal. Accordingly, an open on either the detector or the alarm lines or a shunt on the alarm line will cause a trouble signal and appropriate action should be taken to identify and remedy the trouble condition in order to restore the system to full capability and reliability.

The detector line comprising lead 101 and 102 is not supervised for a shunt condition inasmuch as a shunt condition across the line is created in response to an alarm signaling device 210 or a detector 220. Accordingly, a false shunt or short on the detector line will initiate an alarm signal in the same manner to be described for regular alarm conditions.

The alarm signaling device 210 includes a current limiting resistor R-6 together with contacts 211. The contacts 211 may be arranged to be closed manually, as at a manual pull station, or in response to any of a wide variety of nonstandard conditions which it is desired to monitor and detect. In any event, when the contacts 211 are closed, either manually or automatically, there is a current path from lead 101 through resistor R-6 and the closed contacts 211 to lead 102. The resistance of resistor R-6 will generally not be any lower than may be required to produce the results to be described below. The closing of the contacts 211 will increase the current in the wires 101 and 102 of the detector loop and provide a corresponding increase in the current limiting resistor R-1 thereby increasing the potential at terminal 121. In response to the increased potential at terminal 121 an increased potential will be applied to the positive input of voltage comparator VC-1 and thereby cause it to produce a negative output at terminal 123. The negative potential at terminal 123 will provide a bias through resistor R-3 to the base of transistor T-1 which will turn on thereby allowing a current flow from the positive terminal at the ALM relay through the emitter and collector of transistor T-1 to the negative DC power supply.

The alarm relay ALM is provided with a pair of contacts designated ALM-X which are mechanically constructed in manner that will assure that they make before any other contacts of the relay make or break. As soon as the contacts ALM-X of the ALM relay close, the ALM relay will be locked operated through the named contacts and the switch 130. The switch 130 is a manually actuated switch which is provided for manually releasing the ALM relay at such time as may be expedient. Operation of the ALM relay indicates that an alarm condition has been detected and several actions will take place. However, it is desired first to explain another actuation which may cause the ALM relay to be operated. The detection device 220 includes a detector 224 which may be designed to respond to any of a wide variety of nonstandard conditions including the presence of excessive smoke. Thus, the detector 224 may comprise any of a wide variety of devices and is indicated only generally herein. In response to activation of the detector 224, the lead 225 will be coupled to the lead 223 thereby providing a potential for actuation of the control relay CR1 of the detector 220. Activation of the detector 224 will cause an increase current through the diode bridge 221 and a corresponding increase of the current through wires 101 and 102. Typically, the current will be of the order of 50 milliamperes and this increased current in the line wires 101 and 102 will cause a corresponding increase of current in the resistor R-1 thereby changing the potential at terminal 121 in the same manner as described with respect to the closing of switch 211 in the signaling device 210. Accordingly, it should be appreciated that in response to the activation of any of the devices 210 or 220 and there may be a plurality of each, the relay ALM will be actuated.

The ALM relay when actuated locks itself operated and the activation of any additional signaling devices 210 or detectors 220 will have no further effect at the central station 100 nor with respect to the ALM relay. Operation of the control relay CR1 will cause contacts CR1-A to close and they may be wired in a manner to control any auxiliary equipment in any desired manner which may be expedient in view of the conditions detected by the detector 220. For example, the contacts CR1-A may be used to sound additional local alarms, shut down ventilation systems to inhibit distribution of smoke to other areas, close doors or other openings to limit availability of combustion air, or any of a variety of other operations which may help to promote personal safety and/or prevent further endangerment of property and personnel.

Operation of the ALM relay means that a nonstandard condition which warrants the initiation of an alarm signal has been detected. Accordingly, it is the general objective to respond to the operation of the ALM relay by switching the system from the standby or supervising mode to the alarm mode wherein the alarm signals, be they visual and/or audible, be activated in the zone which had been supervised. As may have been perceived from the prior discussion concerning the alarm loop and the manner of connecting the alarm signals 250 and 260, they will be activated by applying a reverse polarity potential to the alarm loop. It will be shown later that a reverse polarity potential may apply to the detector loop under other conditions and for another purpose.

As already indicated, in response to an alarm signal indicated by an increased current in the detector loop wires 101 and 102, the ALM relay will be operated and its ALM-X contacts will lock the relay operated until it is manually released by switch 130. The ALM-H contacts will release the normally operated PF relay. Release of the PF relay will cause its PF-F contacts to open the circuit to the TBL relay which will release, if it had been operated, or prevented from operation if it had not been operated. Accordingly, during the alarm mode, the ALM relay is the only relay which is operated and the TBL and PF relays are released. It will be seen that the ALM-B contact places a positive potential on wire 104 of the alarm loop and in a similar manner, the ALM-D contact places a negative potential on wire 103 of the alarm line. Fuse 116 is provided in case changing conditions in the protected zone should cause a short circuit on the alarm line. Such condition would blow the fuse 116 which has a lower current rating than the fuse 114 and the ALM relay will remain operated. The reverse polarity on the alarm line will forward bias the diodes D-6, D-7 and D-8 thereby activating the audible alarm 251, the visual alarm 261 and relay CR2. There may be as many of the devices 250, 260 and 270 as may be required to serve the zone 200. In response to the operation of the CR2 relay, the contact CR2-A will close to perform any auxiliary function which is appropriate in response to the alarm condition. With the reverse polarity potential on the alarm line, the diode D-9 is now back biased and no current flows in the end-of-line resistor R-4. This provides a current reduction to limit the load on the batteries 113. If this current limiting feature is not required, the diode D-9 could be omitted. It should be observed that a hard DC potential was applied to the alarm line and the current limiting resistor R-2 which had been in series with the line during the supervisory mode was disconnected by contacts ALM-C.

The release of the PF relay will apply a positive potential through contacts PF-G and ALM-F to the ALM lead to provide a local and/or remote alarm signal as may be required. If there had been prior signals on either the PF, power fail lead, or the TBL, trouble lead, these signals will be removed as the alarm signal has priority. It will be evident that if desired, signals on the lower priority leads could readily be maintained during the alarm condition.

In response to the release of the PF relay, the contacts PF-C will place a positive potential on line 102 of the detector line. The operated contacts ALM-A together with the released contacts PF-A will place a negative potential through fuse 115 to line 101 of the detector line. The fuse 115 is similar in function and purpose to the fuse 116. It should be noted that a hard DC potential is applied to the detector line and the current limiting resistor R-1 which had been in circuit therewith during the supervisory mode is shunted and has ano effect during the alarm mode. With the reverse polarity potential applied to the detector line, the diode D-10 is back biased and no current will flow in the resistor R-5 thereby reducing the current which must be provided by the battery 113 during the alarm condition. The diode D-10 provides another function in connection with the resistor R-5 which will be described hereinbelow.

The alarm sending circuit 210 including switch 211 may have been used to initiate transmission of the alarm signal from the site 200 to the central station 100. The switch contacts 211 may be of either the locking or nonlocking variety. If of a locking variety, the resistor R6 should have as high a value as practical in order to limit the current passed therethrough during the alarm condition. However, it should also be obvious that the value of the resistor R-6 must not be so high that the potential at terminal 121 cannot be sufficiently modified in response to the closure of contacts 211 to cause the operation of the ALM relay all as previously described. With the hard potential applied to the detector line, any of the devices 220 which are coupled to the detector line will have a potential and be able to respond to the changing conditions in the zone 200. That is, as ambient conditions in specific areas of the protected zone 200 may change, the individual detector 224 may be activated thereby energizing the associated CR1 relay to close the CR1-A contact and control associated apparatus all as previously contemplated during design and installation of this system. Depending upon the nature of the controlled auxiliary apparatus, it might be desirable to have it lock in the signal that the contact CR1-A had been actuated until the system is manually reset in order to assure that the controlled apparatus is held in the desired mode in the event that the changing conditions in the zone 200 may open or short circuit the detection line and disable the device 220 causing the release of the relay CR1. Assuming the local conditions do not destroy the integrity of the detector line, the various connected detectors 220 may continue to supervise and respond to ambient conditions.

After the emergency or alarm condition has been investigated and all appropriate action taken, the alarm relay may be released by actuation of switch 130. Typically, the switch 130 is of the momentary actuation or nonlocking type. Depending upon the nature and extent of the damage which may have been caused by the alarm condition, the entire system should be inspected and tested to assure that it is fully operational and ready to respond to the next condition.

Thus far, the system has been described under normal conditions, alarm conditions and trouble conditions comprising lack of integrity of the detector and/or alarm lines. in addition, means are provided for maintaining essential control in the event of the loss of the commercial power supply 110. That is, if the commercial power supply 110 should fail, it is still considered essential that the alarm system be able to respond to and indicate alarm conditions. However, during loss of commercial AC power, supervision of detector and alarm line integrity is removed in order to limit the power drain on the battery 113 and thereby substantially prolong the period during which the system is capable of detecting and responding to an alarm condition. This objective is attained by, in effect, disconnecting the end-of-line terminations 240 and 280.

As is readily apparent, the PF relay is an AC relay and is maintained in its operated state so long as there is a supply of commercial AC power 110 and the ALM relay is not actuated. Accordingly, in response to failure of the AC power supply, the normally operated PF relay will release and the positive potential which is normally applied through closed contacts PF-H to the line 103 will be removed thereby terminating the flow of current in the end-of-line device 280. Normally, such interruption of the alarm line current would be detected by a change of potential at terminal 120 and cause the operation of the TBL relay. However, although this change of potential does take place at terminal 120, the TBL relay is not activated because the release of the PF relay opened the contacts PF-F thereby preventing operation of the TBL relay. With the release of the PF relay, the contacts PF-G close to place a positive potential on the PF lead to provide a local and/or remote signal indicating there has been a power failure. In further response to the release of the PF relay, it will be seen that the contacts PF-C provide a positive polarity on the line 102 of the detector line while the line 101 is coupled through contacts PF-A to the current limiting resistor R-1 and diode D-1. Accordingly, it will be seen that the connection to the detector line remains substantially as it was except that the polarity of the applied potential is reversed. The alarm sending apparatus 210 and the detector devices 220 are not polarity sensitive and either or both may send signals to the central station 100 irrespective of the polarity of the potential applied to the leads 101 and 102 of the detector line. However, the end-of-line network 240 includes a diode D-10 and in response to the reversed polarity on the detector line resulting from the release of the PF relay, the diode D-10 is back biased and no current passes through resistor R-5 and therefore, there is minimal drain on the batteries 113. The detector devices 220 do draw a standby current of the order of 50 microamperes but even several of these on the line is relatively small as compared with the current that would have been drawn by the end-of-line resistor R-5 if the polarity had not been reversed.

In summary, during the period of a commercial power failure, all of the relays at the central station are released, the integrity of the detector and alarm lines is not supervised and the end-of-line terminations are disconnected in order to conserve battery power. The system is fully capable of responding to alarms in the same manner as would take place if commercial AC power was available.

It will be evident to those having familiarity with the use and design of circuits of this nature that if the power failure signal feature and battery saver are not required, that relatively simple changes could be made to eliminate the PF relay and its functions. In such case, all wiring would be completed as hard wiring through the closed contacts of the normally operated PF relay and the ALM-H contacts could be used to open the circuit to the TBL relay. If the power failure feature is not required, the diode D-10 could be eliminated from the end-of-line termination 240. The polarity to the alarm line would still be reversed in response to an alarm condition but the polarity to the detector line would remain unchanged and the ALM-A contacts would continue to shunt out the current limiting resistor R-1.

While there has been shown and described what is considered at present to be the preferred embodiment of the invention, modifications thereto will readily occur to those skilled in the related arts. For example, multiple zones of protection could be provided and/or electromechanical devices substituted for the illustrated voltage comparators. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described and it is intended to cover in the appended claims all such modifications as fall within the true spirit and scope of the invention.

What is claimed is:

1. An alarm system comprising in cooperative combination:

(a) a control station including a source of DC potential;

(b) a detector loop containing at least one polarity insensitive initiating device which may contain an auxiliary relay, said polarity insensitive device detects abnormal conditions, said detector loop is coupled to said control station and has said polarity insensitive device bridged across said detector loop and with said detector loop terminated with a polarity sensitive end of line resistor so that when said system is operating during a power failure the consequential line reversal does not inhibit subsequent said initiating devices;

(c) an alarm indicating loop extending from said control station and having at least one polarity sensitive audio alarm, a polarity sensitive, visual alarm and a polarity sensitive control device bridged across said alarm indicating loop and with said alarm indicating loop terminated with an end-of-line resistor;

(d) first and second current limiting means for coupling said DC potential to said detector and alarm indicating loops, respectively;

(e) first and second voltage comparing means coupled to said detector loop and said alarm indicating loop, respectively, for supervising the respective loop currents and actuating a trouble response means if the current of either falls below a first predetermined value; and (g) third and fourth voltage comparing means coupled to said detector loop and said alarm indicating loop, respectively, for supervising the respective loop currents and activating an alarm response means and said trouble response means, respectively, if the current rises above a second predetermined value in either of the respective loops and wherein said second predetermined value of current is greater than said first predetermined value, whereby said polarity insensitive alarm initiating devices and said auxiliary relay will operate during a power failure.

2. The combination as set forth in claim 1 wherein in response to either of said loop currents falling below its respective first predetermined value said trouble response means changes from a first to a second binary state to provide a trouble alarm.

3. The combination as set forth in claim 2 wherein in response to the current in said alarm loop rising above its second predetermined value said trouble response means changes to its second binary state to provide a trouble alarm.

4. The combination as set forth in claim 3 wherein in response to the current in said detector loop rising above its second predetermined value said alarm response means changes from a first to a second binary state.

5. The combination as set forth in claim 4 wherein in response to said alarm response means changing to said second state said first and second current limiting means are dissociated from their respective loops and a hard DC potential with a reverse polarity is coupled to each of said loops.

6. The combination as set forth in claim 5 wherein in response to said alarm response means changing to said second state said trouble response means is returned to, or maintained in, its first stable state.

7. The combination as set forth in claim 6 wherein in response to said alarm response means changing to said second state a power fail response means is switched from a first stable state to a second stable state.

8. The combination as set forth in claim 7 and including a source of AC potential and a rectifier circuit coupled to said source of DC potential for maintaining said DC potential in a charged condition.

9. The combination as set forth in claim 8 wherein in response to a failure of said AC potential said power fail means is switched to its second stable state, if it had not been switched to its second stable state by said alarm response means.

10. The combination as set forth in claim 9 wherein in response to said power fail response means switching to its second stable state while said alarm response means is in its first stable state the polarity of the DC potential on said detector loop is reversed without dissociation of said first current limiting means and wherein said alarm loop is opened.

11. The combination as set forth in claim 10 wherein in response to the current in said detector loop rising to a value above said second predetermined value said alarm response means is switched to its second stable state.

12. The combination as set forth in claim 11 wherein in response to said alarm response means switching to its second stable state a hard DC potential is applied to both of said loops.

13. The combination as set forth in claim 12 wherein the hard DC potential applied to said loops has a reverse polarity as compared with its polarity when said trouble response means, said alarm response means and second power fail means are in their first stable state.

14. The combination as set forth in claim 10 wherein when said power fail response means is in its second stable state it inhibits said trouble response means from switching to its second stable state.

15. The combination as set forth in claim 14 wherein the end-of-line resistor associated with said detector loop has a diode connected in series therewith and which is polarized to prevent current flow through said end-of-line resistor when the polarity of the DC potential in said detector loop is reversed.

16. The combination as set forth in claim 14 wherein the end-of-line resistor associated with said alarm loop has a diode connected in series therewith and which is polarized to prevent current flow through said end-of-line resistor when the polarity of the DC potential on said alarm loop is reversed.

* * * * *